US010583470B2

(12) United States Patent
Schwarz

(10) Patent No.: US 10,583,470 B2
(45) Date of Patent: Mar. 10, 2020

(54) TREATMENT DEVICE FOR WORKPIECES, COMPRISING AN ELECTRIC TREATMENT UNIT

(71) Applicant: MAFAC Ernst Schwarz GmbH & Co. KG Maschinenfabrik, Alpirsbach (DE)

(72) Inventor: Joachim Schwarz, Freudenstadt (DE)

(73) Assignee: MAFAC Ernst Schwarz GmbH & Co. KG Maschinenfabrik, Alpirsbach (DE)

( * ) Notice: Subject to any disclaimer, the term of this patent is extended or adjusted under 35 U.S.C. 154(b) by 405 days.

(21) Appl. No.: 15/312,512

(22) PCT Filed: May 6, 2015

(86) PCT No.: PCT/EP2015/059898
§ 371 (c)(1),
(2) Date: Nov. 18, 2016

(87) PCT Pub. No.: WO2015/176954
PCT Pub. Date: Nov. 26, 2015

(65) Prior Publication Data

US 2017/0095847 A1 Apr. 6, 2017

(30) Foreign Application Priority Data

May 19, 2014 (DE) ..... 10 2014 107 063

(51) Int. Cl.
*B08B 15/02* (2006.01)
*B08B 3/02* (2006.01)
(Continued)

(52) U.S. Cl.
CPC ..... *B08B 15/02* (2013.01); *B05B 13/0405* (2013.01); *B05B 13/0421* (2013.01);
(Continued)

(58) Field of Classification Search
CPC ..... B08B 3/00–14
See application file for complete search history.

(56) References Cited

U.S. PATENT DOCUMENTS 3,477,931 A * 11/1969 Ogawa ..... C23F 13/04 204/196.02
5,881,853 A 3/1999 Peuster et al.
2015/0209833 A1* 7/2015 Isely ..... B08B 3/022 134/25.1

FOREIGN PATENT DOCUMENTS

DE 19635867 A1 3/1998
DE 19714603 C1 10/1998
(Continued)

OTHER PUBLICATIONS

EP2156905A1 Machine Translation (Year: 2010).*

*Primary Examiner* — Spencer E Bell
(74) *Attorney, Agent, or Firm* — Murphy, Bilak & Homiller, PLLC

(57) ABSTRACT

The invention relates to a treatment device for workpieces, having the following: a treatment chamber (1); a shaft (2) which extends through a wall of the treatment chamber (1) into the treatment chamber and which is mounted in a rotatable manner; an electric treatment unit (3) which is secured to the shaft (2); and a power supply arrangement (6) with a first supply line (61), an electric coupling (63, 64), a second supply line (62), and an actuating unit (7). The electric coupling (63, 64) has a first coupling element (63), which is secured to the shaft (2) outside of the treatment chamber (1), and a second coupling element (64). The first supply line (61) connects the electric treatment unit (3) to the first coupling element (63), and the second supply line (62) is connected to the second coupling element (64). The actuating unit (7) is designed to actuate the coupling (63, 64) in order to bring the second coupling element (64) into
(Continued)

contact with the first coupling element (63) or release the second coupling element (64) from the first coupling element (63).

14 Claims, 7 Drawing Sheets

(51) Int. Cl.

| | |
|---|---|
| ***B05B 13/04*** | (2006.01) |
| ***B08B 3/12*** | (2006.01) |
| ***B08B 3/10*** | (2006.01) |
| ***B05B 16/00*** | (2018.01) |
| ***B08B 5/02*** | (2006.01) |
| ***B08B 7/00*** | (2006.01) |
| ***B08B 7/02*** | (2006.01) |
| ***B08B 7/04*** | (2006.01) |

(52) U.S. Cl.
CPC ..... *B05B 13/0468* (2013.01); *B05B 13/0489* (2013.01); *B05B 16/00* (2018.02); *B08B 3/024* (2013.01); *B08B 3/10* (2013.01); *B08B 3/108* (2013.01); *B08B 3/12* (2013.01); *B08B 5/02* (2013.01); *B08B 7/0071* (2013.01); *B08B 7/028* (2013.01); *B08B 7/04* (2013.01); *B05B 13/0442* (2013.01); *B05B 13/0447* (2013.01)

(56) References Cited

FOREIGN PATENT DOCUMENTS

| | | |
|---|---|---|
| EP | 0507294 B1 | 8/1994 |
| EP | 1346779 A2 | 9/2003 |
| EP | 2156905 A1 | 2/2010 |

* cited by examiner

TREATMENT DEVICE FOR WORKPIECES, COMPRISING AN ELECTRIC TREATMENT UNIT

Exemplary embodiments of the present invention relate to a treatment device for workpieces.

After a production or machining process, metal parts especially frequently require a cleaning treatment before the parts can be installed or further processed. Cleaning may also be required within the context of reprocessing workpieces, such as, for example, engine blocks. For such a treatment, there are treatment devices with a treatment chamber, a parts receiving device arranged in the treatment chamber, and with a nozzle device which is arranged in the treatment chamber and serves for dispensing a treatment medium. This treatment medium is a liquid medium for cleaning treatment, or a gaseous medium for cleaning and/or drying treatment. Treatment devices of this type are described, for example, in EP 0 507 294 B1, WO 98/45059 A1 or EP 2 156 905 A1.

Against the background of needing to carry out complex and highly effective cleaning or drying processes with such treatment devices, there is the requirement to arrange electric treatment units rotatably in the treatment chamber. A problem in this connection is to ensure the power supply of the rotatable treatment unit through the chamber wall.

It is therefore the object of the present invention to provide a treatment device for workpieces, which has an electric treatment unit in a treatment chamber, and in which an electric supply of the treatment unit is ensured in a manner which is simple and relatively cost-effective to realize, and to provide a method for operating such a treatment device.

This object is achieved by a treatment device as claimed in claim 1 and a method as claimed in claim 15. Refinements and developments are the subject matter of the dependent claims.

An exemplary embodiment relates to a treatment device for workpieces. The treatment device comprises a treatment chamber, a shaft which extends through a wall of the treatment chamber into the treatment chamber and which is mounted rotatably, an electric treatment unit which is fastened to the shaft, and a power supply with a first supply line, an electric coupling, a second supply line and an actuating unit. The electric coupling comprises a first coupling element, which is fastened to the shaft outside the treatment chamber, and a second coupling element. The first supply line connects the electric treatment unit to the first coupling part, and the second supply line is connected to the second coupling part. The actuating unit is designed to actuate the coupling in order to bring the second coupling part into contact with the first coupling part, or to release the second coupling part from the first coupling part.

A second exemplary embodiment relates to a method for operating such a treatment device. The method comprises the operation of the treatment device in a first operating state, in which the second coupling part is in contact with the first coupling part, or in a second operating state, in which the second coupling part is released from the first coupling part.

Exemplary embodiments are explained below with reference to figures. The figures are not necessarily true to scale. The figures serve to explain the basic principle, and therefore only those features which are necessary for this purpose are illustrated in the figures and are explained in detail below.

Figure 4A:
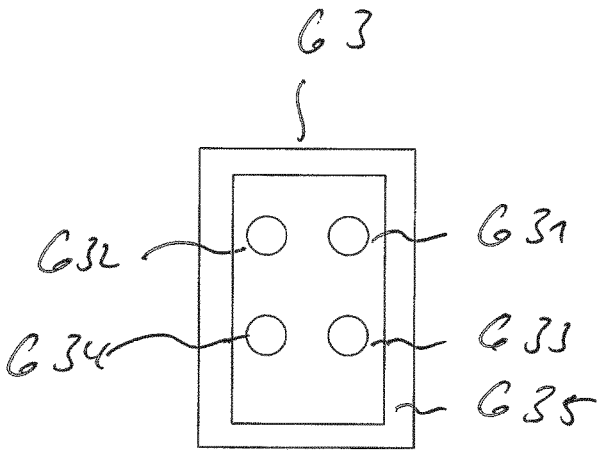
Figure 4B:
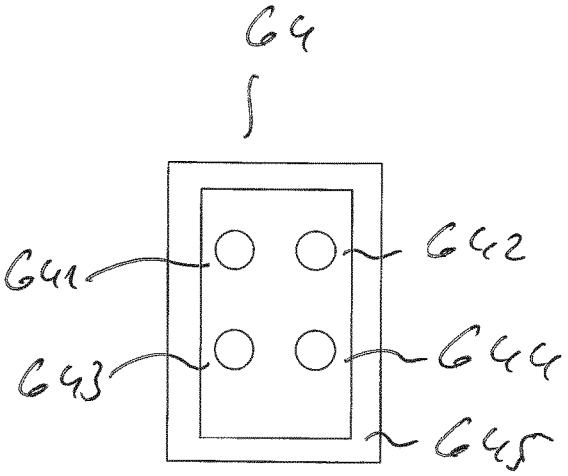
Figure 5:
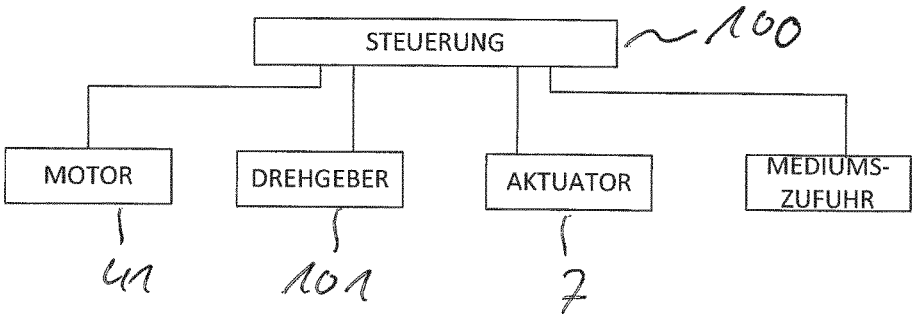

FIGS. 4A-4B schematically show a first coupling part and a second coupling part of an electric coupling of the power supply arrangement; and FIG. 5 shows a block diagram for illustrating the manner of operation of the treatment device.

Figure 1A:
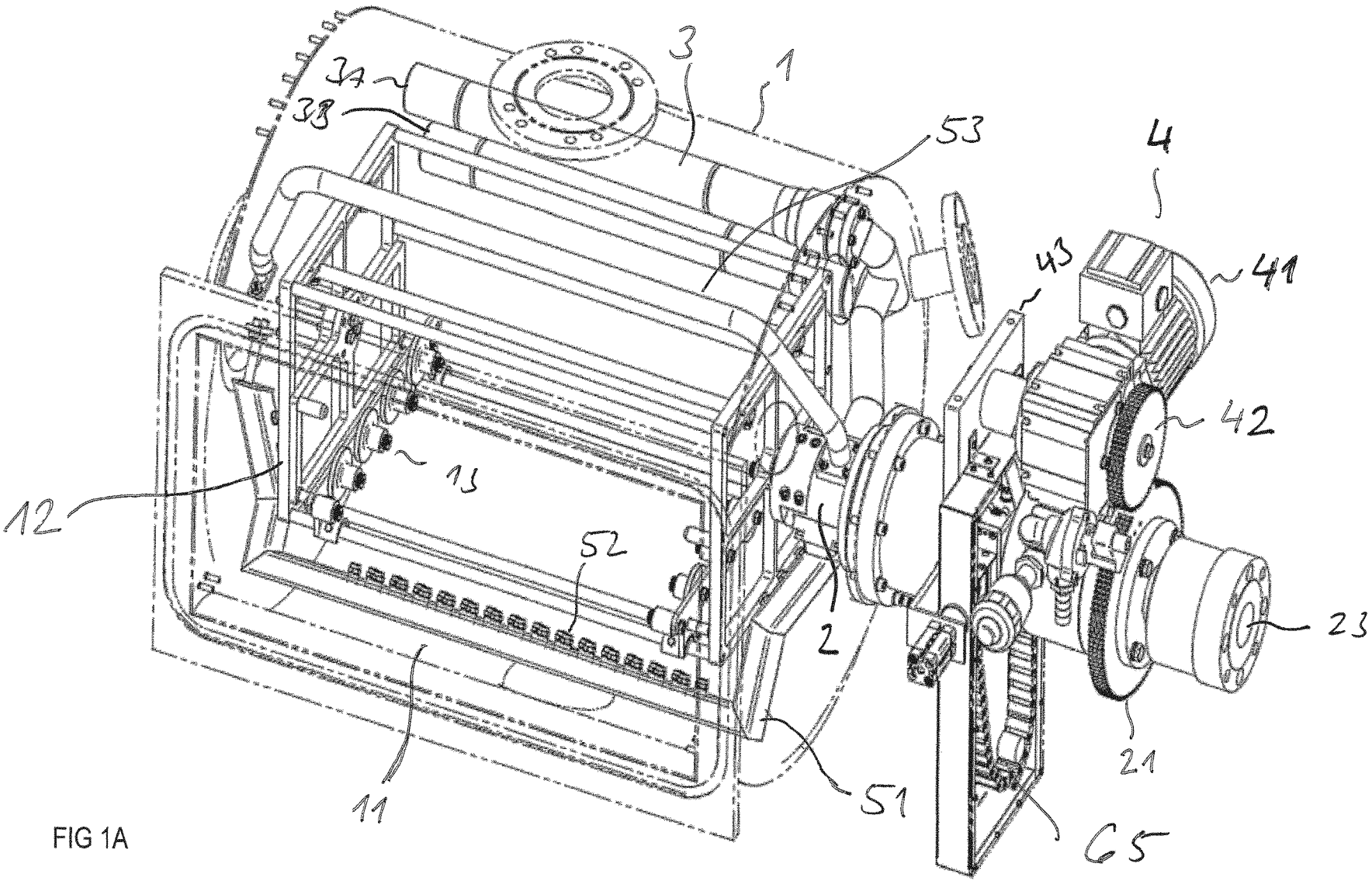
FIGS. 1A-1B illustrate an exemplary embodiment of a treatment device with reference to a perspective view (FIG. 1A) and with reference to a detail of the treatment device in a perspective view (FIG. 1B)
Figure 1B:
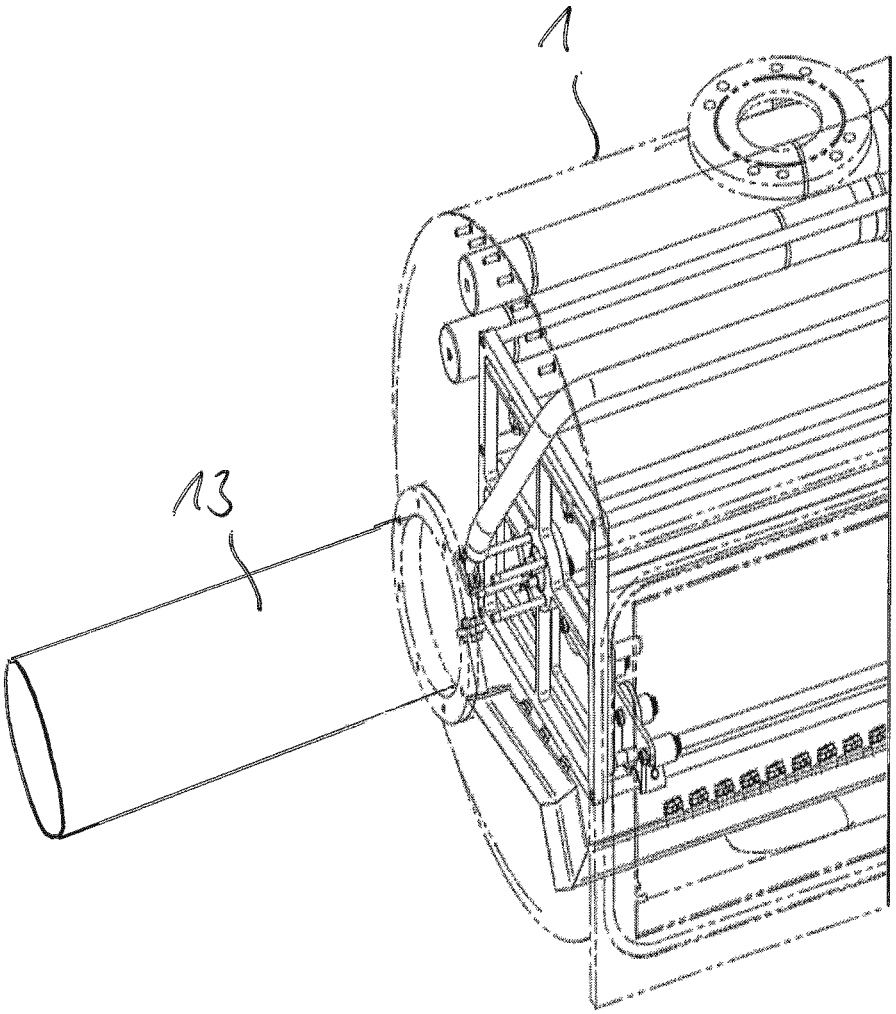

FIGS. 1A-1B show an exemplary embodiment of a treatment device for workpieces, which has a treatment chamber 1 and an electric treatment unit 3 arranged rotatably in the treatment chamber 1. FIG. 1A shows a perspective view of the treatment chamber 1 (which is illustrated in a phantom view) and further treatment device elements that are also explained below. FIG. 1B shows a perspective view of a part of the treatment chamber 1 from a different viewing angle.

With respect to FIG. 1A, the treatment device comprises a shaft 2 which extends through a wall of the treatment chamber 1 into the treatment chamber and which is mounted rotatably in relation to the treatment chamber 1. In the exemplary embodiment illustrated, the treatment chamber 1 is substantially cylindrical, and the shaft 2 is introduced into the treatment chamber 1 on an end side of the cylindrical treatment chamber 1. However, this is merely an example. The treatment chamber 1 could also have a different chamber geometry and could be, for example, spherical.

For the loading of the treatment chamber 1 with workpieces to be treated, the treatment chamber 1 has a feed opening 11. In the exemplary embodiment illustrated, said feed opening 11 is situated on a side wall of the treatment chamber 1, which side wall runs substantially perpendicularly to the end wall, via which the shaft 2 is guided into the treatment chamber 1. A closure (cover) with which the feed opening 11 can be closed is not illustrated in the figures. According to an exemplary embodiment, the closure is designed to close the feed opening 11 in a water- and pressure-tight manner in order thereby to hermetically seal the treatment chamber 1 for the treatment operation. In this connection, "in a pressure-tight manner" means that the closure in the closed state withstands a positive pressure (in relation to the ambient pressure outside the treatment chamber 1), for example of several bar (2 bar, 5 bar or more) or else a negative pressure, for example of up to approximately 0 bar. The treatment chamber 1 comprises seals (not illustrated) in the region in which the shaft 2 is guided through the chamber wall. Said seals are designed in a manner corresponding to the closure in order to close the treatment chamber 1 in a water- and pressure-tight manner.

With regard to FIG. 1A, a parts receptacle 12 which serves to hold parts to be treated during the treatment process is arranged in the interior of the treatment chamber 1. In an exemplary embodiment, the parts receptacle 12 is designed to receive baskets in which workpieces to be treated lie loosely (as bulk goods). According to a further exemplary embodiment, the parts receptacle 12 is designed to receive individual large workpieces, such as, for example, engine blocks. The parts receptacle 12 can have rollers 13 which facilitate an "entry" and "exit" of the workpiece baskets or of the workpieces into/out of the treatment chamber 1 via the feed opening 11.

According to an exemplary embodiment, the parts receptacle 12 is mounted rotatably in relation to the treatment chamber 1. In this case, the treatment device 1 comprises a further shaft 13 (compare FIG. 1B). Said further shaft 13 can be guided on a chamber wall into the treatment chamber 1 which lies opposite the chamber wall on which the shaft 2 is guided into the treatment chamber 1. This shaft 13 can be driven in a motorized manner. Such a rotatably arranged parts receptacle 12 is basically known, and therefore the explanation of further details of said parts receptacle, such as, for example, of the associated drive device, can be omitted here.

With regard to FIG. 1A, the shaft 2 is driven, for example, by an electric driving device 4. Said driving device 4 comprises, for example, an electric motor 41 and a transmission, of which a gearwheel 42 is illustrated in FIG. 1A. The driving device acts, for example, on a gearwheel 21 which is fastened to the shaft 2 and is connected to the shaft 2 with a force fit. In addition, the driving arrangement 4 can comprise a mounting plate 43 to which the motor 41 is fastened. According to an exemplary embodiment, the shaft 2 is guided through an opening (not illustrated) in the mounting plate 43. The mounting plate 43 can be fastened to a housing (not illustrated) of the treatment device in a manner not illustrated specifically. Said housing surrounds all of the treatment device components that are illustrated in FIG. 1A and supports said treatment device.

With regard to FIG. 1A, an electric treatment unit 3 is fastened to the shaft 2 in the interior of the treatment chamber 1. The electric treatment unit 3 comprises, for example, an ultrasonic transducer which is designed in order, in a switched-on state, to produce ultrasonic waves in a medium surrounding it, such as, for example, a treatment liquid. In the exemplary embodiment illustrated in FIG. 1A, the electric treatment unit 3 comprises two rod-shaped ultrasonic transducers 3A, 3B which are arranged substantially parallel to each other.

Figure 2:
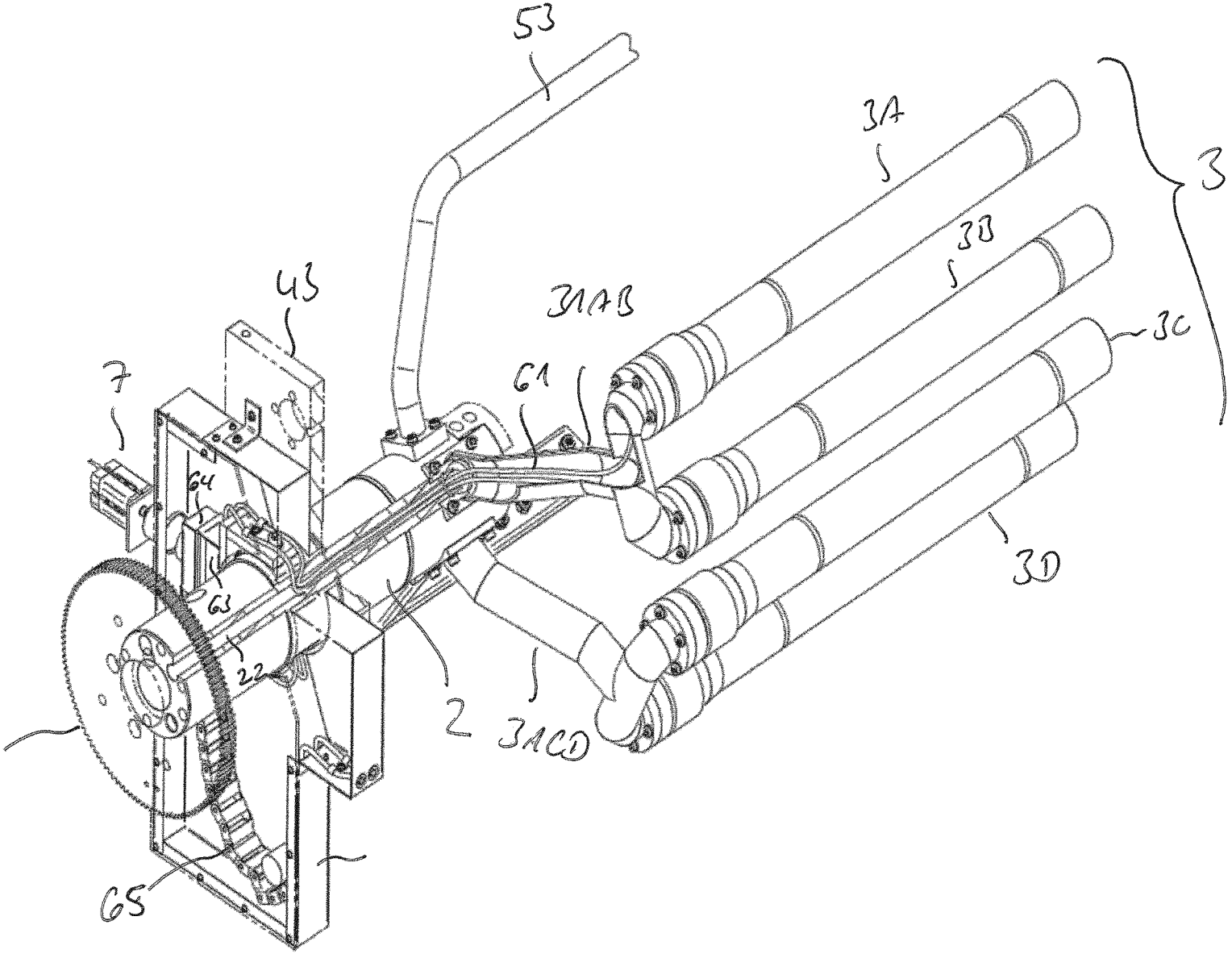
FIG. 2 shows a perspective view of an example of a treatment unit.

FIG. 2 shows a further exemplary embodiment of a treatment device, wherein the treatment chamber 1 is not illustrated in FIG. 2. In the exemplary embodiment illustrated in FIG. 2, the electric treatment unit 3 comprises four such rod-shaped ultrasonic transducers 3A-3D. However, the provision of a plurality of ultrasonic transducers is merely an example. In a further exemplary embodiment, provision is made to provide only one of the ultrasonic transducers illustrated in FIGS. 1A and 2. In addition, the provision of rod-shaped ultrasonic transducers is only an example. Other types of ultrasonic transducers could also be used.

In the exemplary embodiments illustrated in FIGS. 1A and 2, the rod-shaped ultrasonic transducers 3A-3B and 3A-3D, respectively, run substantially parallel to the shaft 2 to which they are fastened. In the example illustrated, for the fastening of the ultrasonic transducers 3A-3D to the shaft 2, connecting elements (31AB, 31CD in FIG. 2) are provided which extend away from the shaft 2 substantially in the radial direction. Said connecting elements 31AB, 31CD are fastened to the shaft 2 at ends facing the shaft 2, for example by means of screw connections. The ultrasonic transducers 3A-3D are fastened to ends of the connecting elements 31AB, 31CD that face away from the shaft 2, An electric treatment unit with ultrasonic transducers, like the electric treatment unit 3 illustrated in FIGS. 1A and 2, is only an example of an electric treatment unit. Instead of an electric treatment unit with ultrasonic transducers or in addition to such an electric treatment unit with ultrasonic transducers, other types of electric treatment units also could also be fastened to the shaft 2 in the interior of the treatment chamber 1. An "electric treatment unit" is understood as meaning an electric treatment unit, for the operation of which electrical energy (power) is required. Such an electric treatment unit is, for example, also a treatment unit with an electric heating element or with an electrically adjustable nozzle. In the case of an electric heating element, the power is used to generate heat which is output to the environment in the treatment chamber. In the case of an electrically adjustable nozzle, the power is used to adjust or to pivot or to do similar to the nozzle. The nozzle is, for example, a nozzle for cleaning liquid or for a gaseous medium, such as, for example, air. Such a nozzle can have any type of drive which is supplied by electric power, for example a drive with a piezo element, a transmission, hydraulics or similar.

Figure 3A:
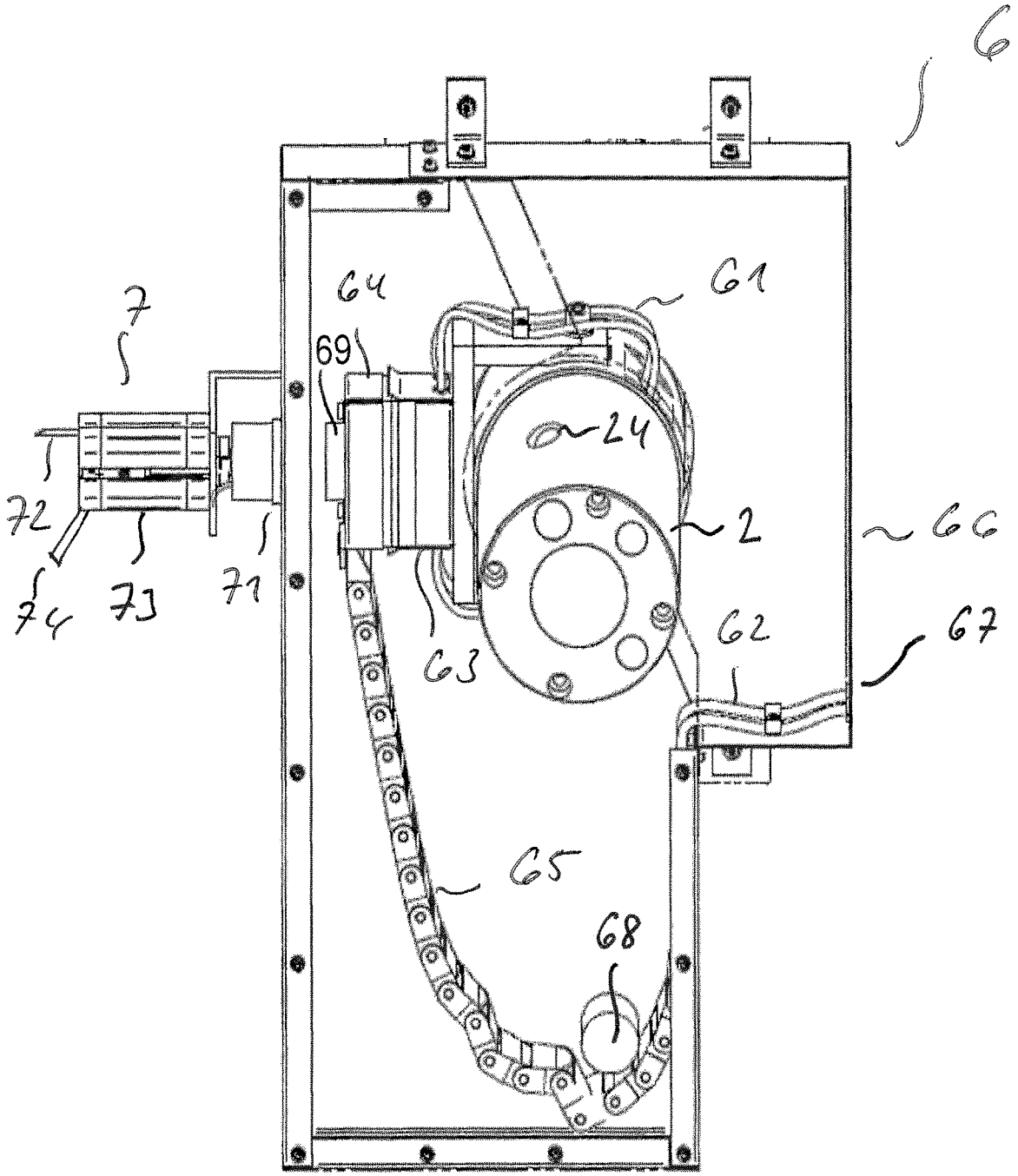
FIGS. 3A-3C illustrate an example of a power supply arrangement for the treatment unit.
Figure 3B:
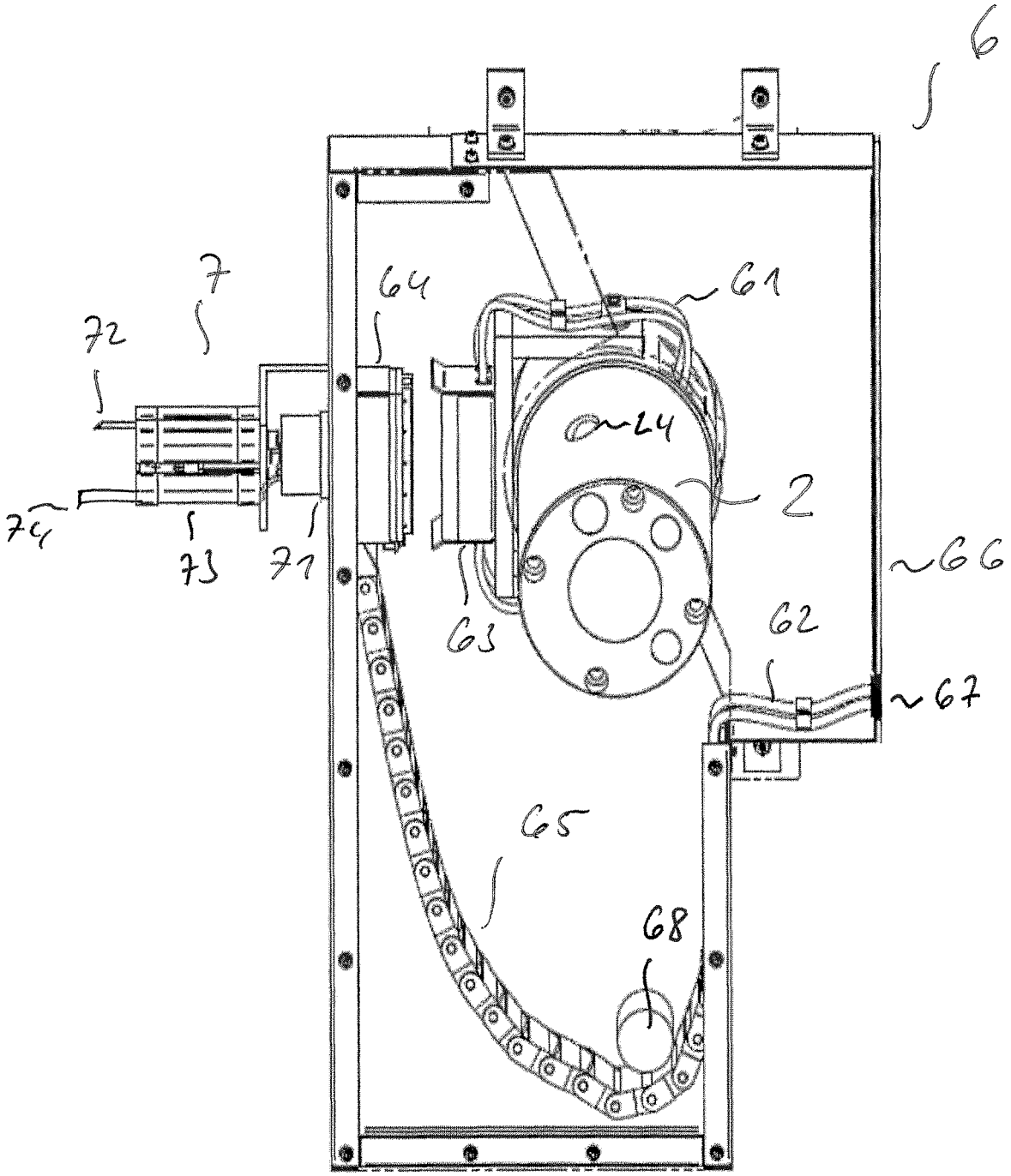
Figure 3C:
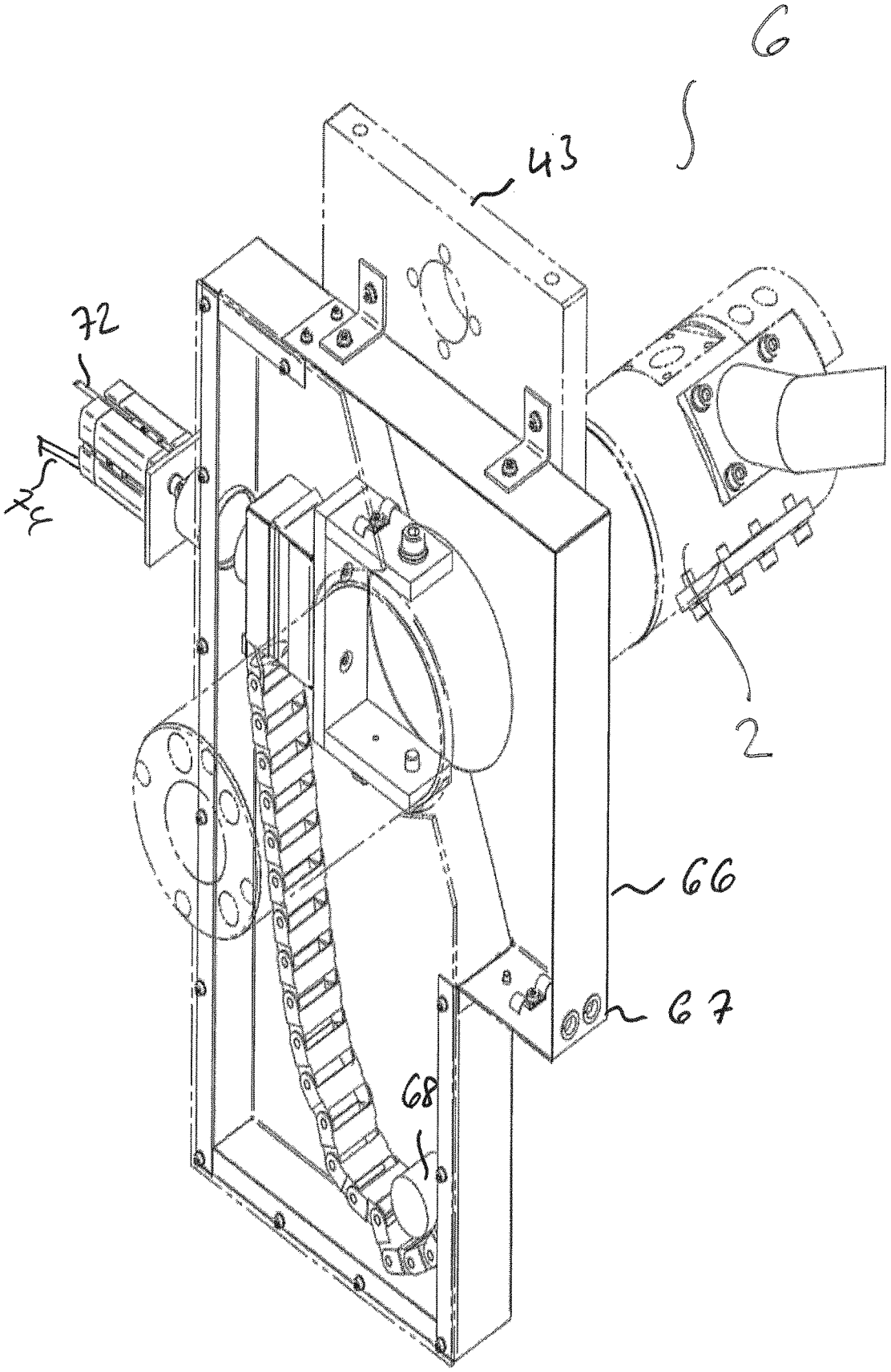

In order to supply the electric treatment unit 3, which is arranged in the interior of the treatment chamber 1, with electrical energy (power), the treatment device comprises a power supply arrangement. FIGS. 3A-3C illustrate an exemplary embodiment of such a power supply arrangement 6. Parts of said power supply arrangement 6 are also illustrated in FIGS. 1A and 2.

The power supply arrangement comprises an electric coupling with a first coupling element 63, which is fastened to the shaft 2 outside the treatment chamber 1, and a second coupling element 64, at least one first supply line 61, at least one second supply line 62 and an actuating unit 7 for the electric coupling 63, 64. The at least one first supply line 61 connects the electric treatment unit 3 to the first coupling element 63. This is illustrated by way of example in FIG. 2. FIG. 2 shows two first supply lines, namely a first supply line for each one of the ultrasonic transducers 3A, 3B. First supply lines for the ultrasonic transducers 3C, 3D are outside the illustration according to FIG. 2. With regard to FIG. 2, the at least one first supply line 61 is guided at least in sections within the shaft 2. For this purpose, the shaft 2 has an axially running cable channel 22 which is illustrated cut open in FIG. 2. This cable channel 22 which, in the example, accommodates two first supply lines runs from outside the treatment chamber (which is not illustrated in FIG. 2) within the shaft 2 up to in the treatment chamber. The first supply line 61 emerges within the treatment chamber 1 out of the cable channel 22 of the shaft 2 and is guided from there to the treatment unit 3, which is fastened to the shaft 2. In the exemplary embodiment illustrated in FIG. 2, the illustrated at least one first supply line 61 runs within the connecting part 31AB, which is fastened to the shaft 2, to the associated ultrasonic transducer 3A, 3B.

Outside the shaft 2, the at least one first supply line 61 runs out of the cable channel 22 to the first coupling part 63 which is fastened to the shaft 1 outside the treatment chamber 1. The course of the first supply line 61 from the cable channel of the shaft 2 to the first coupling element 63 is illustrated in FIGS. 3A and 3B. FIG. 3C shows the power supply arrangement without the first and second supply lines 61, 62.

The power supply arrangement 6 can have a housing 66 in which the first coupling element 63, the second coupling element 64, that portion of the first supply line 61 which is arranged between the first coupling element 63 and cable channel and the second supply line 62 are arranged. This housing 66 protects the abovementioned components of the power supply arrangement 6 from soiling and moisture during operation. A rear wall and side walls of said housing 66 are illustrated in FIGS. 3A-3C. A front covering is not shown in the figure. The rear wall has a cutout though which the shaft 2 runs. The covering (not illustrated) of the housing 66 has a corresponding cutout. According to an exemplary embodiment, a seal is provided in the region of the cutouts of the rear wall and the covering, the seal preventing moisture and dirt from penetrating into the housing 66 in the region of the shaft 2. With reference to FIG. 3C, the housing 66 can be fastened to the previously mentioned mounting plate 43 (also see FIG. 1A).

The second supply line 62 is introduced into the housing 66 at a cable inlet 67. The second supply line 62 is connected to a power source (not illustrated). For this purpose, the second supply line 62 can extend outside the housing 66 as far as the power source. Alternatively, there is the possibility of connecting the second supply line 62 via a further supply line (not illustrated) to the power source. The power source is a power source suitable for the electrical supply of the treatment unit 3. The type of power source is therefore dependent on the type of electric treatment unit 3. In the case of an electric treatment unit 3 with ultrasonic transducers (as illustrated in FIGS. 1A-1B and 2), the power source is a high-frequency generator which is designed to generate a high frequency signal suitable for activating the ultrasonic transducers 3A-3D. Said high frequency signal supplies the electric treatment unit 3 via the at least one second supply line 62, the coupling 63, 64 and the at least one first supply line 61 when the first and the second coupling elements 63, 64 are coupled to each other.

In the coupled state, i.e. when the first coupling element 63 is coupled to the second coupling element 64 of the coupling, the coupling provides an electrically conductive connection between the first supply line 61 and the second supply line 62. The coupling with the two coupling elements 63, 64 can be a conventional electric coupling which is coordinated with the respective intended use, i.e. which is suitable for connecting the two supply lines 61, 62 for the supply of the treatment unit 3 in an electrically conductive manner to each other.

FIG. 3A shows the coupling elements 63, 64 in the coupled state (connected electrically to each other), and FIG. 3B shows the two coupling elements 63, 64 in the decoupled state (separated electrically from each other).

For the coupling or decoupling of the two coupling elements 63, 64, the treatment device has an actuating unit 7. Said actuating unit 7 comprises an actuating element 71 which can be brought into connection with the second coupling element 64 with a force fit in order to connect the second coupling element 64 to the first coupling element 63 or in order to release the second coupling element 64 from the first coupling element 63.

According to an exemplary embodiment, the force-fitting connection between the actuating element 71 and the second coupling element 64 is produced by the use of magnetic forces. For this purpose, it is provided that the actuating element 71 or the second coupling element 64 have a solenoid, and that the other of said two components in each case has a magnetic counterpart on which the solenoid can act. In an exemplary embodiment, the actuating element 71 comprises a solenoid and the second coupling element 64, on a side facing away from the first coupling element 63, comprises a magnetic counterpart 69 on which the actuating element 71 with the solenoid can act. The magnetic counterpart 69 comprises a magnetic material, for example a magnetic metal. The solenoid in the actuating element 71 is activated via a control line 72 which is illustrated schematically in FIGS. 3A-3C. The solenoid is either activated or deactivated via said control line 72. In the activated state, the solenoid can be brought into connection with the magnetic counterpart 69 on the second coupling element 64 with a force fit.

In order to be able to move the second coupling element 64 in the direction of the first coupling element 63 (in order to couple said coupling elements) or in order to be able to pull the second coupling element 64 off the first coupling element 64 (in order to separate said coupling elements), the actuating unit 7 comprises a linear drive 73 to which the actuating element 71 is fastened. For this purpose, the linear drive 73 is designed to move the actuating element 71 linearly in order to be able to bring the actuating element 71 into contact with the second coupling element 64 and thus to actuate the second coupling element 64, that is to say to pull the latter off the first coupling element 63 or to bring the latter into contact with the second coupling element 63. The linear drive 73 comprises, for example, a pneumatic cylinder or an electric linear motor. The linear drive 73 is supplied or activated via a further feed line 74.

Referring to FIG. 3A, the at least one second supply line 62 forms within the housing 66 a cable loop which, when the first and the second coupling elements 63, 64 are coupled to each other, permits rotation of the shaft 2 without the second supply line 62 being torn off or damaged in some other way. The second supply line 62 can be guided within the housing 66 in a trailing cable 65. The extent to which the shaft 2 can rotate when the coupling 63, 64 is coupled, without the coupling 63, 64 itself being detached or the second supply line 62 tearing off is dependent on the length of the second supply line 62 within the housing 66, i.e. dependent on the length of spare line in the second supply line 62. According to an exemplary embodiment, the second supply line 62 is dimensioned in such a manner that the shaft 2, when the coupling 63, 64 is coupled, has a rotational range of at maximum 180°, at maximum 270°, at maximum 360°, or even at maximum 720°. The "rotational range" refers to an angular range between a first end point and a second end point of the shaft. The "first end point" denotes an angular position, up to which the shaft 2, when the coupling 63, 64 is coupled, can be rotated in a first direction without there being the risk of damage to the power supply arrangement, and "the second end point" denotes an angular position of the shaft 2, up to which the shaft 2 can be rotated in a second direction of rotation opposed to the first direction of rotation without there being the risk of damage to the power supply arrangement.

FIGS. 3A and 3B show the shaft 2 in an angular position in which the actuating unit 7 can couple the two coupling elements 63, 64 to each other or can decouple same from each other. Starting from said angular position, in the example illustrated, the shaft 2 can be rotated for a distance in a first direction, which corresponds in the example to the clockwise direction, without there being the risk of the second supply line 62 tearing off. The cable loop of the second supply line 62 below the shaft 2 is then shortened and the second supply line winds around the shaft 2. An optional tensioning element 68, which is displaceable in the vertical direction in the example, keeps the second supply line 62 in this case tensioned or keeps the loop upright. In the example illustrated, the shaft 2 can be rotated in the clockwise direction by up to 360°. In the opposed direction (i.e. counterclockwise in the example), the shaft 2 in the example can likewise be rotated about 360° without there being the risk of the supply line 62 tearing off. In this case, the shaft can therefore be rotated in both directions by 360°, i.e. by +/−360°. The rotational range is therefore 720°, since the two end points 720° lie apart from each other.

In the example illustrated, the further supply line 62 is introduced on a side wall into the housing 66. The actuating unit 7 is situated on a side wall of the housing 66, which side wall lies opposite the first side wall. However, this is only an example. The second supply line 62 can be introduced into the housing 6 at any point. A crucial factor for the permissible rotational range of the shaft 2 when the coupling is coupled is the length of spare cable of the second supply line 62 that is present within the housing 66, i.e. the length of the second supply line 62 within the housing 66. The longer said supply line 62 is, the greater is the rotational range.

The coupling with the two coupling elements 63, 64 can be a conventional electric coupling which ensures an electrically conductive connection between the two supply lines 61, 62. One of the two coupling elements 63, 64 can thus have, for example, contact pins which, in the coupled state, plug into corresponding sockets in the other coupling element. According to a further example, the two coupling elements 63, 64 have contacts which are designed as spring contacts.

A mechanical connection between the two coupling elements 63, 64, which connection prevents the coupling from becoming automatically detached, can be ensured in different ways, for example by means of clamping elements, spring elements or the like. According to a further exemplary embodiment, it is provided that one of the two coupling elements 63, 64, on a contact surface facing the other coupling element in each case, has a permanent magnet which, in the coupled state of the coupling elements 63, 64, is connected with a force fit to a magnetic counterpart of the other coupling element in each case in order to keep the two coupling elements 63, 64 together in the coupled state.

FIGS. 4A and 4B each show top views of a contact surface of the first coupling element 63 (FIG. 4A) and of the second coupling element 64 (FIG. 4B) according to an example. In the exemplary embodiment illustrated, each of the coupling elements 63, 64 comprises four contacts 631-634 or 641-644. Each contact element of a coupling element has a corresponding contact element on the other coupling element in each case and is electrically in contact therewith when the two coupling elements 63, 64 are coupled. The individual contact elements 631-634 or 641-644 can be designed as conventional electric contacts, for example as spring contacts. There is also the possibility of realizing one of the corresponding contacts as a contact pin and the other of the corresponding contacts as a contact socket. The number of contact elements is as desired and is dependent on the respective purpose or the number of electric consumers to be supplied, and is therefore not restricted to four.

At least one of the two coupling elements 63, 64 has, on the contact surface, a permanent magnet which, in the coupled state, acts on a magnetic counterpart of the respective other coupling element 63, 64. In FIGS. 4A and 4B, the permanent magnet and the magnetic counterpart are denoted by the reference numbers 635, 645. In the exemplary embodiment illustrated, these are arranged annularly around the contacts 631-634 and 641-644. However, this is only an example. Any other geometry is likewise possible.

It is provided in the exemplary embodiment that a permanent magnet is present. Said permanent magnet corresponds either, in FIG. 4A, to the element denoted by the reference number 635 or, in FIG. 4B, to the element denoted by the reference number 645. The counterpart is then composed of a magnetic material, such as, for example, a magnetic metal. According to another exemplary embodiment, it is provided for a permanent magnet to be provided on each of the two coupling elements 63, 64, wherein said magnets are arranged on the contact surfaces in such a manner that the permanent magnets have opposed magnetic poles on the contact surfaces, i.e. on the surfaces which are in contact with each other when the coupling is coupled, i.e. that the permanent magnets attract each other.

The solenoid of the actuating element 7 and the magnetic counterpart 69 on the second coupling element 64 are dimensioned in such a manner that the actuating element 7 is capable of releasing the second coupling element 64 from each other counter to the magnetic force caused by the at least one permanent magnet and the magnetic counterpart of the coupling elements 63, 64.

In the explained treatment device, the rotational range of the shaft 2, when the coupling 63, 64 is coupled, is restricted in the previously explained manner. The shaft 2 cannot in particular be fully rotated repeatedly consecutively in one direction. However, any desired pivoting, that is to say an alternating rotation of the shaft in one direction of rotation and in the opposed direction of rotation, is possible as desired within the possible rotational range. In particular in the case of a treatment device with a rotational range of 360°, the treatment unit 3 can be positioned at any angular position within the treatment chamber 1 or can be pivoted to and fro as desired within the rotational range. When the coupling 63, 64 is decoupled, there is no restriction in respect of a rotational movement of the shaft 2. That is to say, the shaft in this case can be fully rotated repeatedly in a consecutive manner in one direction.

In one example, it is provided that in addition to the electric treatment unit 3, a first nozzle tube 51 (compare FIG. 1A) is fastened to the shaft 2. Said nozzle tube 51 comprises a plurality of nozzles 52 which are arranged along the nozzle tube and via which cleaning liquid in the treatment chamber 1 can be output in the direction of the parts receptacle 12, and therefore in the direction of the workpieces to be cleaned. Cleaning liquid is fed to the nozzle tube 51 from outside the treatment chamber 1 via a liquid channel 23. In the exemplary embodiment illustrated, the said liquid channel 23 runs centrally within the shaft 2. Within the treatment chamber 1, a bore running radically in the shaft 2 leads into said liquid channel 23. The nozzle tube 51 is fastened to the shaft 2 in the region of said radial bore in such a manner that cleaning liquid can pass via the liquid channel 23 and the radial bore into the nozzle tube 51. Cleaning liquid is fed into the liquid channel 23 of the shaft 2, for example, via a feed tube (not illustrated in the figures) which is arranged outside the treatment chamber and in relation to which the shaft 2 is rotatably mounted. It can be ensured via conventional seals that no liquid emerges in the region in which the feed tube is coupled to the shaft 2.

Referring to FIGS. 1A and 2, the treatment device can comprise a further nozzle tube 53 which is fastened to the shaft 2. Said further nozzle tube 53 serves, for example, for introducing a gaseous medium, such as, for example, air, into the treatment chamber 1. The gaseous medium can be used, for example, for drying the workpieces previously cleaned with cleaning liquid. In order to introduce said gaseous medium into the further nozzle tube 53, the shaft 2 comprises a further feed channel which runs within the shaft in the longitudinal direction thereof from outside the treatment chamber into the treatment chamber. This further feed channel leads within the treatment chamber 1 into the further nozzle tube 53 and is accessible outside the treatment chamber via a bore 24 running perpendicularly to the longitudinal direction. Said bore 24 is illustrated by way of example in FIGS. 3A and 3B. For the introduction of the gaseous medium into the further feed channel of the shaft 2, and therefore into the further nozzle tube 53, an annular channel (not illustrated) can be provided which surrounds the shaft 2 in the circumferential direction in the region of the bore 24. Said annular channel leads into the bore 24 in each angular position of the shaft 2. An annular channel of this type for feeding a gaseous medium into a shaft of a treatment device is known, and therefore further statements in this regard can be dispensed with.

When the coupling 63, 64 is uncoupled, the treatment device can be operated as a conventional treatment device. That is to say, in one treatment step, cleaning liquid can be output via the first nozzle tube 52 to workpieces in the treatment chamber 1, wherein the first nozzle tube 52 can be rotated or pivoted as desired in the shaft 2 in the treatment chamber 1. In another treatment step, a gaseous medium can be output via the second nozzle tube 53 in the treatment chamber to the workpieces. This can take place for drying the workpieces. However, it is also possible to produce a liquid bath in the treatment container 1 and to output the gaseous medium into said liquid bath, as a result of which the liquid bath is swelled, which can result in a high level of cleaning activity. The liquid bath can be undertaken by introducing cleaning liquid via the first nozzle tube 52. In a further exemplary embodiment, it is provided that the treatment chamber 1 has an additional liquid inlet (not illustrated). Of course, the treatment chamber 1 also has a liquid outlet at a lower end in order to be able to remove again cleaning liquid previously introduced into the treatment chamber 1.

When the coupling elements 63, 64 are coupled to each other, the rotational range of the shaft 2 is restricted in the previously explained manner. An electric treatment unit 3 with an ultrasonic transducer (as illustrated in FIGS. 1A and 2) can be used, for example, after a liquid bath is produced in the treatment chamber 1, to output ultrasonic waves to the liquid bath in order thereby to clean the workpieces located in the liquid bath. The treatment unit 3 can be pivoted here in the previously explained manner within the treatment chamber 1 by alternating rotation of the shaft in one direction and in the opposed other direction.

The shaft 3 is rotated by the previously explained motor 41 in a manner controlled by a controller. Said controller is not illustrated in the figures. FIG. 5 shows a block circuit diagram for explaining the functioning of the treatment device and for explaining the interaction of the individual previously explained elements. Referring to FIG. 5, the treatment device has a controller 100. Said controller can comprise, for example, a programmable controller, such as, for example, a microprocessor. The controller 100 controls the motor 41 which rotates the shaft 2 in accordance with the controller 100. The controller 100 receives information about the current angular position of the shaft 2 from a rotary encoder 101 which is arranged in the region of the shaft 2 in a manner not illustrated specifically and which transmits the current angular position of the shaft 2 to the controller 100. The controller 100 also controls the actuating unit 7 for the coupling 63, 64 and optionally the feeding of the cleaning liquid or of the gaseous medium via the shaft 3 to the two nozzle devices 52, 53.

For the coupling or decoupling of the two coupling elements 63, 64, the controller 100 moves the shaft 2 via the motor 41 into a coupling position. This is the position illustrated in FIGS. 3A and 36. In this position, the actuating element 71 of the actuating arrangement 7 can act on the second coupling element 64. If the coupling 63, 64 is coupled and is intended to be decoupled, the controller 100 ensures that the solenoid of the actuating element 71 is energized and causes the linear drive 73 to move linearly in the direction of the second coupling element 64 as far as an end position at which a force-fitting connection between the actuating element 71 and the magnetic counterpart 69 is ensured. The controller 100 subsequently causes the linear drive 73 to move in the opposite direction in order to decouple the second coupling element 64 from the first coupling element 63.

In the decoupled state, the second coupling element 64 is held permanently by the actuating element 71, i.e. the solenoid remains energized until the two coupling elements 63, 64 are coupled again to each other.

For the coupling of the second coupling element 64 and of the first coupling element 63, the controller likewise causes the shaft 2 to be moved by the motor 41 into the coupling position. The controller 100 then causes the linear drive to move in the direction of the first coupling element 63, specifically as far as an end position at which the first coupling element and the second coupling element are coupled to each other. The energizing of the solenoid of the actuating element 71 is then interrupted in order to be able to move the actuating element 71 away from the second coupling element 64. This likewise takes place in a manner controlled by the controller 100. The actuating element 71 is moved here into a standby position (illustrated in FIG. 3A) at which the actuating element 71 remains until the two coupling elements 63, 64 are intended to be decoupled again.

The invention claimed is:

1. A treatment device for workpieces, comprising:

a treatment chamber;

a shaft extending through a wall in the treatment chamber into the treatment chamber and which is mounted rotatably;

an electric treatment unit fastened to the shaft; and a power supply arrangement having a first supply line, an electric coupling, a second supply line and an actuating unit, wherein the electric coupling comprises a first coupling element fastened to the shaft outside the treatment chamber, and a second coupling element, wherein the first supply line connects the electric treatment unit to the first coupling element, wherein the second supply line is connected to the second coupling element, wherein the actuating unit is configured to actuate the electric coupling so as to bring the second coupling element into contact with the first coupling element, or so as to release the second coupling element from the first coupling element, wherein the actuating unit is further configured to hold the second coupling element at a predefined position spaced apart from the shaft when the second coupling element is released from the first coupling element, so that the first coupling element is moveable relative to the second coupling element when the shaft rotates.

2. The treatment device of claim 1, wherein the electric treatment unit comprises at least one of: an ultrasonic transducer; an electric heating element; and an electrically adjustable nozzle.

3. The treatment device of claim 1, wherein the first supply line runs at least in sections within the shaft.

4. The treatment device of claim 1, wherein the second supply line runs at least in sections in a trailing cable.

5. The treatment device of claim 1, wherein the first coupling element and the second coupling element each have a contact surface facing each other when the second coupling element is brought into contact with the first coupling element, and wherein one of the first coupling element and the second coupling element has a magnet on its contact surface and the other one of the first coupling element and the second coupling element has a first magnetic counterpart to the magnet on its contact surface.

6. The treatment device of claim 5, wherein the magnet is a permanent magnet.

7. The treatment device of claim 5, wherein the first magnetic counterpart has a permanent magnet or a magnetic metal.

8. The treatment device of claim 1, wherein the actuating unit is configured to be brought into connection with the second coupling element with a force fit.

9. The treatment device of claim 8, wherein one of the actuating unit and the second coupling element has a solenoid and the other one of the actuating unit and the second coupling element has a magnetic counterpart.

10. The treatment device of claim 9, wherein the actuating unit has a linearly movable actuating element to which the solenoid or the magnetic counterpart is fastened.

11. The treatment device of claim 1, further comprising:

at least one first nozzle tube fastened to the shaft in the treatment chamber; and at least one first medium channel which runs within the shaft and which leads into the at least one first nozzle tube.

12. The treatment device of claim 11, further comprising:

at least one second nozzle tube is fastened to the shaft in the treatment chamber; and at least one second medium channel which runs within the shaft and leads into the at least one second nozzle tube.

13. The treatment device of claim 1, further comprising:

a further shaft extending through a wall of the treatment chamber into the treatment chamber and which is mounted rotatably; and a parts receptacle fastened to the further shaft in the treatment chamber.

14. The treatment device of claim 1, wherein the treatment chamber is closable in a water- and pressure-tight manner.

* * * * *